US005134949A

United States Patent [19]

Almog et al.

[11] Patent Number: 5,134,949

[45] Date of Patent: Aug. 4, 1992

[54] HIGH-SPEED BOAT

[75] Inventors: Zeev Almog, Ramat Hasharon; Michael Abraham, Givat Ha'ela; David Sela, Haifa; Josef Ophir, Haifa; Miron Rubinstein, Haifa; Dan Rabin, Moshav Hayogev, all of Israel

[73] Assignee: Israel Shipyards Limited, Haifa, Israel

[21] Appl. No.: 563,352

[22] Filed: Aug. 7, 1990

[30] Foreign Application Priority Data

Aug. 10, 1989 [IL] Israel ..... 91273

[51] Int. Cl.[5] ..... B63B 1/16

[52] U.S. Cl. ..... 114/1; 114/56

[58] Field of Search ..... 114/56, 71, 343, 1; 440/38, 111

[56] References Cited

U.S. PATENT DOCUMENTS 3,174,452 3/1965 Rickborn ..... 114/71

3,845,923 11/1974 Atkinson ..... 440/111 X 4,566,397 1/1986 Cavanaugh ..... 114/71 X

FOREIGN PATENT DOCUMENTS 1119926 10/1984 U.S.S.R. ..... 440/11

*Primary Examiner*—Sherman Basinger

*Attorney, Agent, or Firm*—Dennison, Meserole, Pollack & Scheiner

[57] ABSTRACT

A ship of the 50 ton class includes a deep-V hull shape which is a partially monohedron fully planing hull with a hand chine and two bottom risers, a water jet propulsion system cooperating with a motor, and control apparatus for controlling the motor and propulsion system. Preferably, the motor is a 16 cylinder marine diesel engine having a maximum speed of between about 1800 and 2100 rpm and a maximum power of about 1900 kW, while the water jet is a high speed, high rpm water jet having a maximum water jet speed of between about 1400 and 1600 rpm, the water jet coupled to the motor by means of a reduction gear between about 1:1.15 and 1:1.

13 Claims, 8 Drawing Sheets

HIGH-SPEED BOAT

FIELD OF THE INVENTION

The present invention relates to water craft in general and, in particular, to high speed motorized water craft.

BACKGROUND OF THE INVENTION

Water craft and motorized water craft for a variety of purposes have long been known. These craft have different shapes and are of different weights, depending upon the use of the craft. The traditional hull shape is the displacement hull, which is supported by buoyancy. However, due to the large surface area in contact with the water, the speed of such craft is limited.

In an effort to overcome the disadvantages of the displacement hull, the planing hull was developed which lifts most of the hull out of the water during travel. Ships with this sort of hull travel very rapidly in smooth water. But in waves, these ships are subject to pounding or slamming, so must be driven at lower speeds. One method for improving performance of the planing hull is the deep-V design, which cuts through the waves to reduce pounding.

To date, the intended use of the ship has determined both its weight and its hull shape. Thus, racing boats are generally as light weight as possible, in order to improve the ship's speed, and include a deep-V hull in an attempt to reduce pounding. On the other hand, patrol boats and other ships, which are subject to slamming on rough seas, are built with relatively thick protective walls and are, therefore, much heavier, and are traditionally made with a flatter semi-displacement hull which is very fast in quiet waters but which tends to slam in rough seas.

Furthermore, patrol boats and other relatively heavy boats are generally propeller driven. The conventional drive system includes high speed, fast engines which have a high power/weight ratio. There are known racing boats with water jet propulsion systems, but such systems are relatively new and more expensive than traditional propeller propulsion systems, as well as being less efficient in fuel consumption at certain speeds.

At present, high speed on rough seas has been achieved by hydrofoils of certain design and some hovercraft. However, the price of manufacturing and maintaining these craft is very high.

The internal layout of conventional patrol craft was designed with speed of movement from the closed bridge to the open bridge in mind. Thus, the open bridge A is located only one half flight up from the closed bridge B and aft thereof, as shown in FIG. 7, which illustrates a prior art ship. This leads to a number of disadvantages. First, the area C underneath the open bridge is essentially wasted space, and is used for storage. Second, in order to see over the closed bridge and the bow, the open bridge must be placed as far forward as possible. Thus, the closed bridge B is generally contracted to as small an area as possible. Furthermore, the stairway D from below comes up directly into the closed bridge, which is inconvenient and problematic during an emergency.

SUMMARY OF THE INVENTION

It is an object of the present invention to provide a craft suitable for use as a patrol boat or as a minibus which is light weight, fast in both rough and quiet water, relatively inexpensive to build and maintain, and which permits the comfortable travel of a number of customs officials or other passengers in relatively protected quarters.

There is thus provided in accordance with the present invention a ship of the 50 ton class including a hull shape as disclosed in the accompanying body plan, a water jet propulsion system cooperating with a motor, and control means for controlling the motor and propulsion system.

According to a preferred embodiment of the invention, the motor comprises a low speed, low maintenance, high reliability engine, such as the MWM TBD 604B V16, while the water jet comprises a high speed, high rpm water jet coupled to the motor by means of a reduction gear.

Further according to the invention, there is provided a ship having an open bridge disposed directly above a closed bridge.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1A:
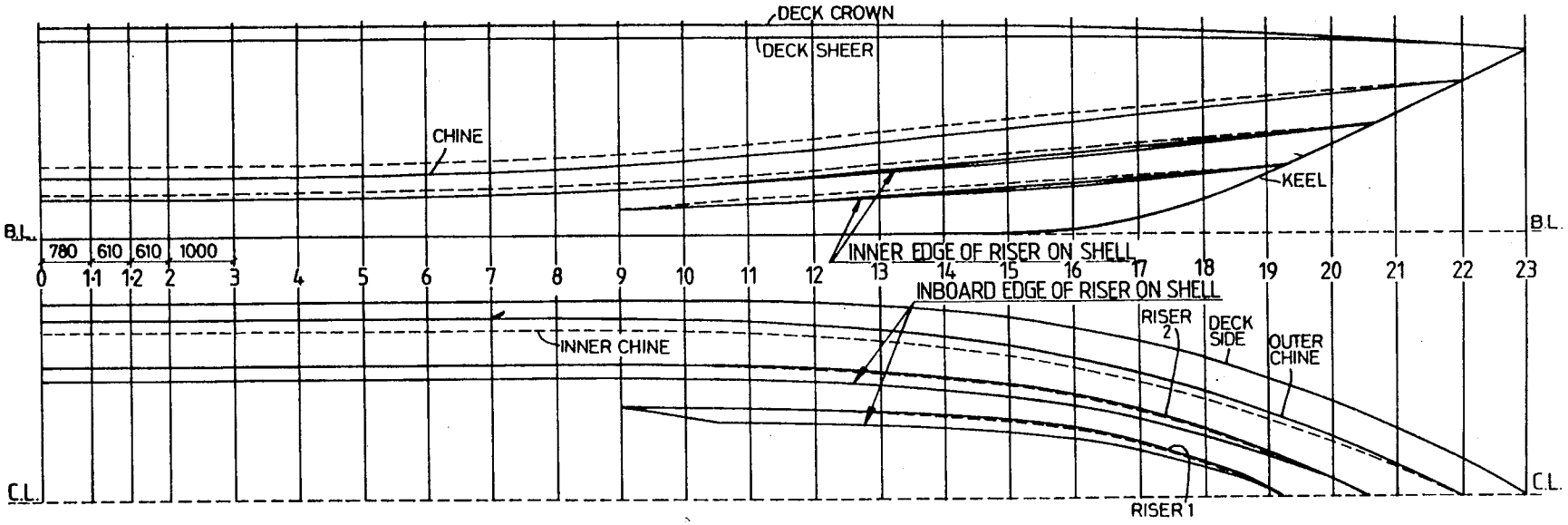
FIGS. 1*a* and 1*b* are lines drawings showing respective side and front views of the body plan of ship constructed and operative in accordance with the present invention.

The present invention relates to a high speed water craft of the 50 ton class particularly useful as a patrol boat, which can maintain speeds of 45 knots in sea state 2 and 3 for 550 miles without significant slamming. This high speed and seaworthiness are made possible by the combination of unique hull shape of the type associated with racing ships, together with a water jet propulsion system and associated engine generally utilized in heavier craft. The ship is preferably fabricated of aluminum and light weight materials and is designed to be as light as possible.

The designation of craft size by referring to "ton class" is conventional in water craft as an approximate designation of the size of the craft. Thus, a 50 ton class designation for a ship conventionally indicates a ship of a size which displaces 50 tons, plus or minus approximately 10 tons. Thus, the "ton class" is not intended as a precise definition of size, but as a reference order of magnitude. For example, the 50 ton class water craft described herein is not comparable to a ship of the 20 ton class.

Both the desk and the interior of the ship have been designed ergonometrically for maximum utilization of space while retaining a feeling of comfort for the crew. There is no water splashing on the deck as the hull is provided with risers or spray strips too push the water sideways and prevent splashing.

It is a particular feature of the ship of the present invention that there is no propeller. Thus, there is no need to fear breakdown of the propulsion system due to hitting a barrier in the sea. Furthermore, the craft can move easily in shallow water and can even beach, if desired.

Figure 1B:
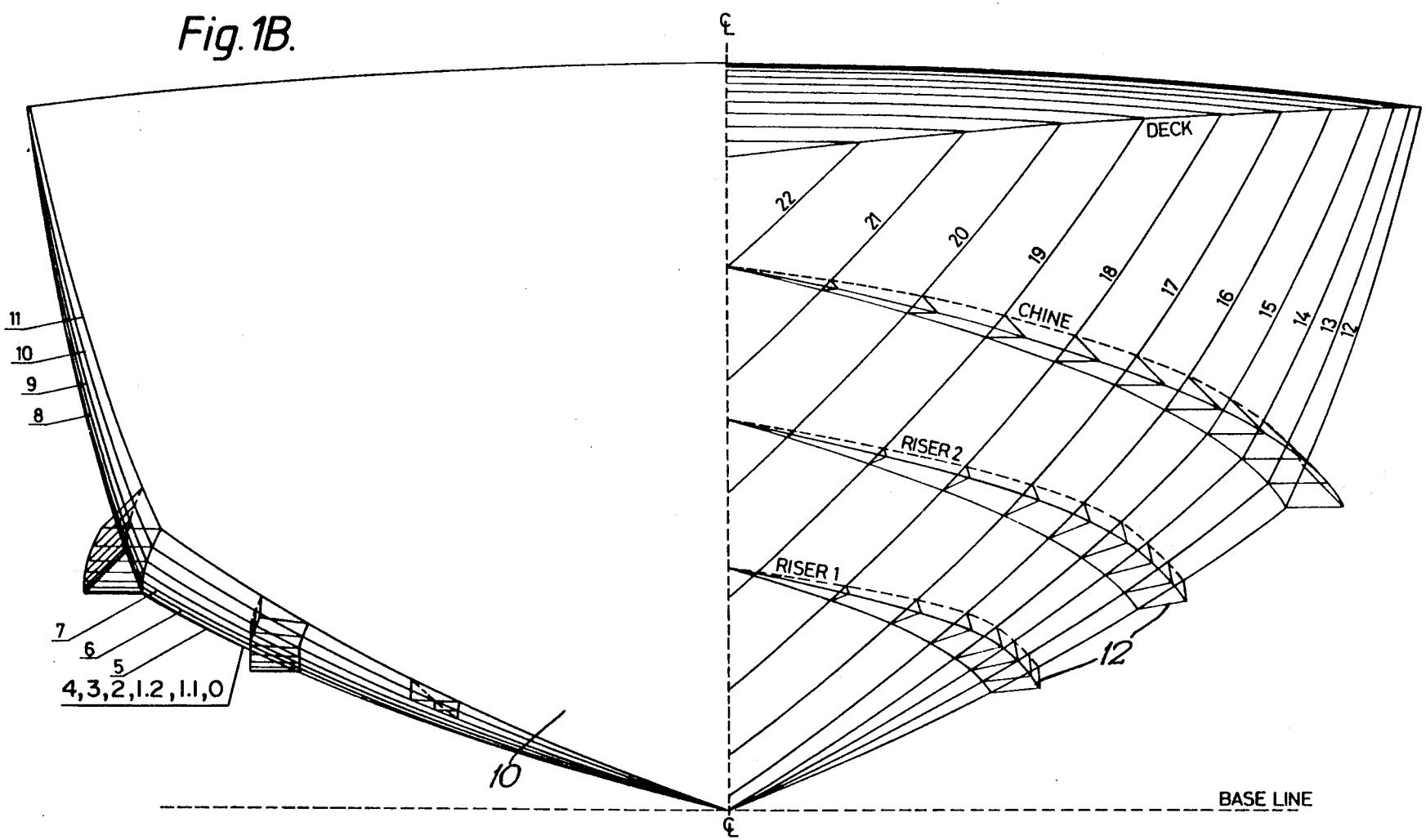

Referring now to FIGS. 1*a* and 1*b* there are shown lines drawings of respective side and front views of the body plan of a ship constructed and operative in accordance with the present invention with the frames 0 to 23 at a preferred frame spacing of approximately 1 meter. This unique body plan has particular advantages as far as speed and passenger comfort are concerned. First, a deep-V hull 10, which is a partially monohedron, fully planing hull, with special high deadrise aft and deep-Vee sections forward, is provided to cut through the waves. Second, the hull has a hard chine and two bottom risers or spray strips 12 to prevent splashing of water upwards onto the deck. Third, this particular body form provides very fast travel both on smooth and rough seas. All these characteristics substantially prevent slamming. A monohedron hull, as known in the shipbuilding art, refers to a hull whereon the shape of the deep V is formed by convex surfaces disposed at an angle relative to one another which is constant along a portion of the length of the hull. In the illustrated example in FIG. 1B, from frame 0 (the transom) to Frame 4, approximately 4 meters along the longitudinal axis of the ship, the angle between the port and starboard surfaces of the V remains substantially constant. This form was selected for the good performance it gives due to its low resistance and anti-slamming characteristics.

The hull lines are of a planing, dynamically supported hull which can operate on or above water and its characteristics are completely different from those of conventional displacement ships. Similar lines (not identical) do exist on racing boats such as the Virgin Atlantic, Challenger II. The lines of the ship of the present invention have been developed on the basis of a similar hull shape and have been modified based on performance experience and operational requirements.

The preferred shape, proportions and dimensions of the chine are as follows:

Maximum Chine Beam—Inner = 5.00 m (at transom).

Maximum Chine Beam—Outer = 5.50 m (at transom).

The plan view of the inner chine shows a straight line parallel to centerline from transom to frame 7 with a maximum beam of 5.00 m. The chine beam gradually decreases from frame 7 to frame 22 (0.0 m). The chine beam at midship (frame 10) is 4.92 m.

The outer chine (external strip) has a triangular shape having a breadth of 250 mm from frame 0 to frame 7 and gradually decreasing to 0.0 at frame 22. The lower edge of the external chine is horizontal and the upper face has a slope of 45 degrees and is tapered forward following the hull lines.

The chine heights above base line are as follows:

At frame 0:0.910 m (horizontal up to frame 2)

At frame 10:1.117 m

At frame 14:1.500 m

At frame 22:2.325 m

The slope of chine forward of frame 10 is about 6 degrees.

The geometry of the two illustrated risers is as follows. The upper riser extends from the transom (frame 0) beyond frame 20. The riser is parallel to centerline between frame 0 and frame 9, having a breadth of 3.66 m at the inboard edge on the bottom shell. The beam of the riser is gradually decreasing to 0.0 between frame 20–21.

The heights of the inner edge of the riser on the shell above the base line are as follows:

frame 0-frame 2:0.581 m frame 10:0.735 m frame 14:1.004 m frame 20:1.597 m The slope of the riser forward of frame 10 is about 5 degrees.

The lower riser extends between frame 9 and frame 19–20. The beam of the riser at frame 10 is 2.72 m, gradually decreasing to 0.0 beyond frame 19. The height of the inner edge of the riser above the base line is 0.453 m at frame 10 and 1.007 m at frame 19. The riser slope is about 3.5 degrees.

The external strips defining the outer sides of the upper and lower risers have a triangular shape. The breadth of the lower edge of the strips is 210 mm. The angle between the lower and side faces of the triangular strips is 90 degrees. The outer sides of the risers are gradually tapered forward maintaining proportions.

The keel line of the craft is horizontal between frame 0 and frame 14. As shown in FIGS. 1A and 1B, the forward hull portion which extends for approximately the forward third of the craft has a deep V shape. The shaped bow has a slope of about 25 degrees.

The transverse sections are V-shaped. The deadrise angle of the planing hull bottom varies from 20 degrees at the transom to 44 degrees at the bow. The type of section is convex.

Regarding the deck line, the deck camber is 200 mm while the deck sheer is horizontal at aft, decreasing sheer forward.

At rest, the length of waterline is 19.56 m and the corresponding draught is 1.15 m.

Figure 4:
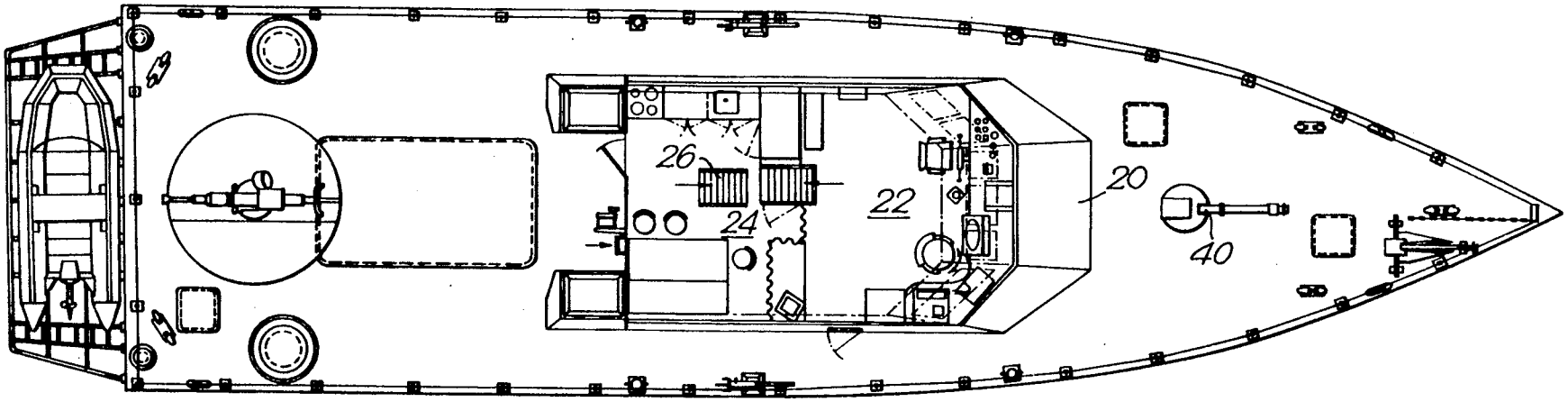
FIG. 4 is a plan view of the main deck of the craft of FIG. 2.
Figure 5:
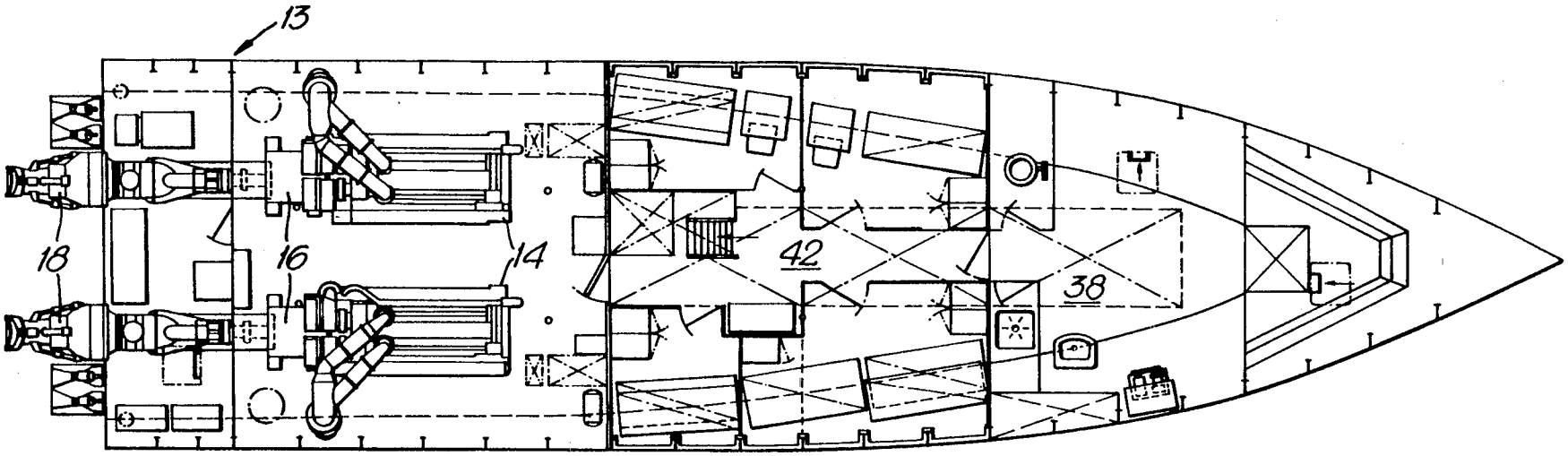
FIG. 5 is a plan view of the below deck space of the craft of FIG. 2.
Figure 6:
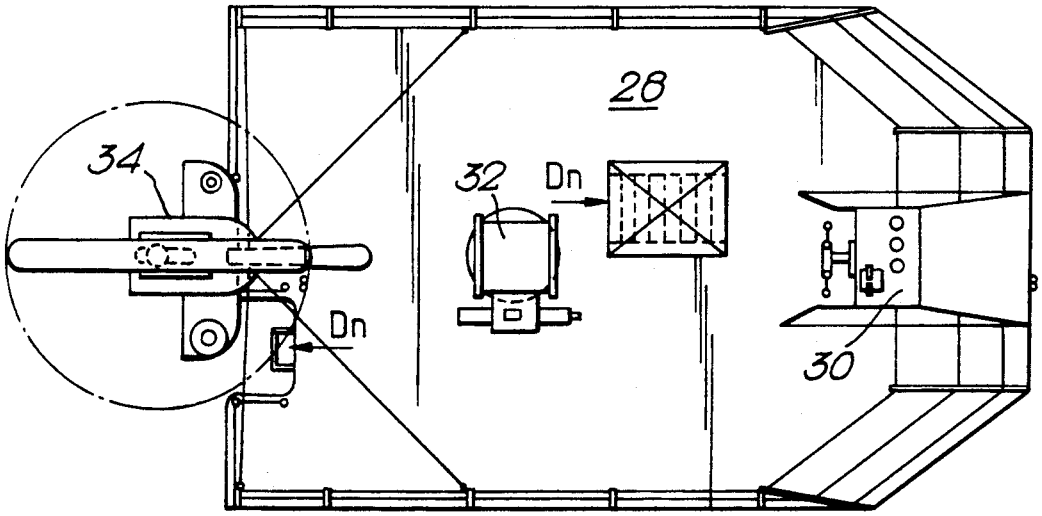
FIG. 6 is a plan view of the open bridge of the craft of FIG. 2.

Referring now to FIGS. 2 through 6 there is shown a fast patrol craft constructed and operative in accordance with the present invention in respective side, front and plan elevations and including a hull 10 embodying the body shape of FIG. 1*b* together with a functional interior design. With particular reference to FIG. 5, there is shown in plan view the propulsion system, generally designated 13.

The design incorporates diesel-driven waterjet propulsions which significantly increase propulsion efficiency at high speeds compared with conventional propellers. Propulsion system 13 comprises port and starboard diesel engines 14 coupled via a reduction gear 16 to water jet propulsors 18. Engines 14 may comprise any suitable engines capable of driving the water jets. According to a preferred embodiment, each engine 14 comprises a relatively low speed, low maintenance, high reliability diesel engine, such as the Deutz MWM TBD 604B V16, manufactured by Deutz-Mannheim Motorwerken, Germany.

These preferred engines are marine diesel engines, fourstroke, 16 cylinders in V configurations, direct injection, watercooled, turbo-charged, charge air cooled. The engine rating is as follows.

Continuous rating 100%: 1595 kw at 1690 rpm

Overload rating for two hours within twelve hours, 110%: 1754 kw at 1745 rpm

Maximum rating for one hour within six hours, 120%: 1914 kw at 1800 rpm

Preferably, the engine's maximum speed is about 1800 rpm and its maximum power is about 1900 kW. Despite the fact that this is a relatively big, heavy engine, it is preferred due to its low price and good maintainability.

Water jets 18 may comprise any water jet propulsion system suitable for driving a ship of the weight of the patrol boat. According to a preferred embodiment, the water jets comprise high speed, high rpm water jets, such as Model IRC 64 DLX, manufactured by Riva Calzoni, Italy. Preferably, the maximum water jet speed is between 1400 and 1600 rpm.

Figure 2:
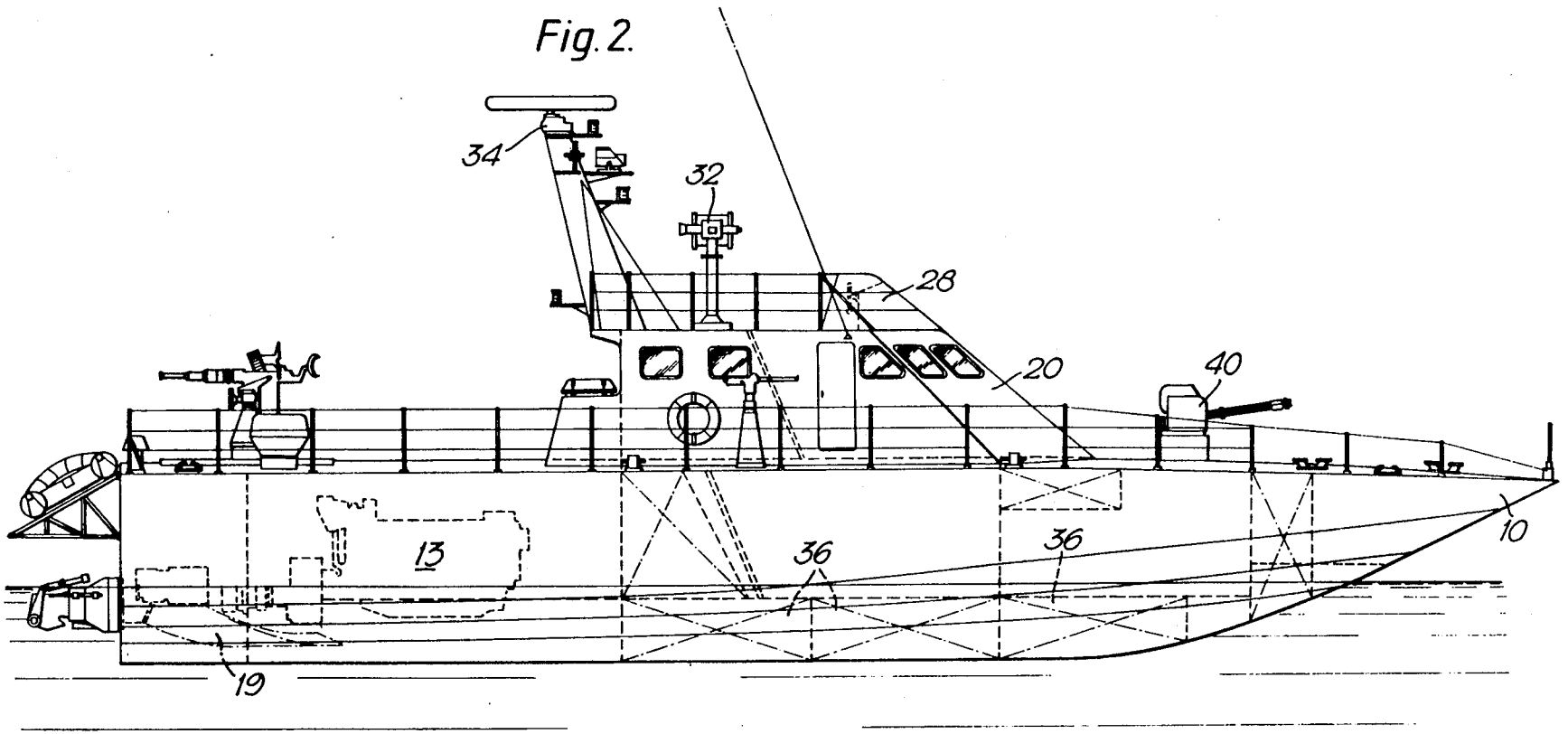
FIG. 2 is a side elevation of a fast patrol craft constructed and operative in accordance with the present invention.
Figure 3:
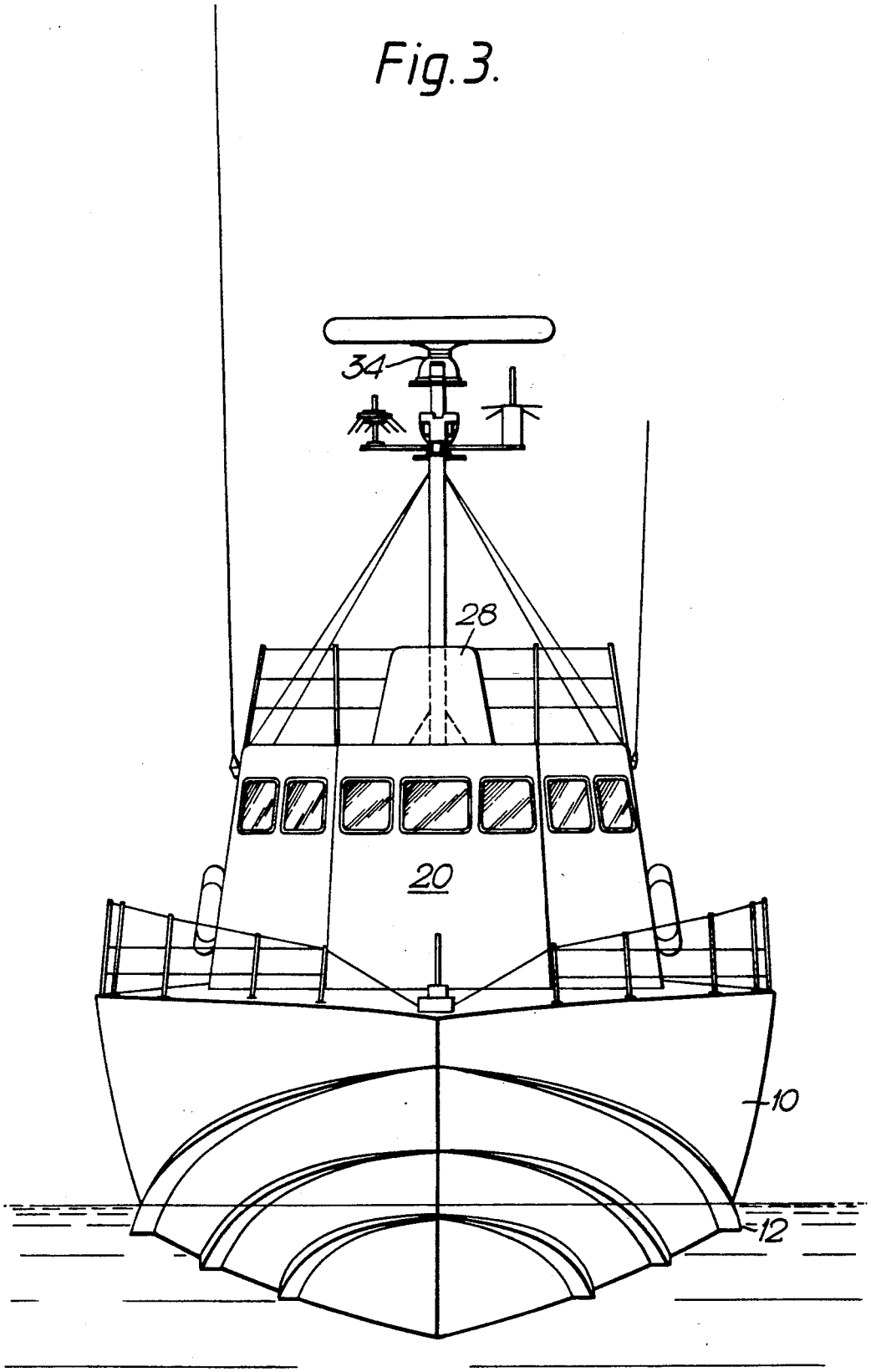
FIG. 3 is a front elevation of the craft of FIG. 2.

It will be appreciated by those skilled in the art that the water jet inlet must be suited to the shape of the ship. There is shown in FIG. 2 a side sectional view of a preferred embodiment of the inlet duct 19 for the craft of the present invention. The inlet duct feeding water to the pump consists of a tube extending from the bottom plating to the transom of the vessel and has special hydrodynamic shape to assure an optimum efficiency in different operating conditions. The criteria for the shape of this duct are that it permit the intake of sufficient water to drive the ship, that there not be any parts protruding from the hull of the ship, and that, when the ship is planing, the inlet remains under water.

Steering forces are generated by deflecting the jet sideways, by means of the steering nozzle. Reversing is achieved by deflecting the jet in a forward-down direction by means of a reversing bucket.

The water jets 16 are coupled to the engines 14 by reduction gears 16, which may comprise any suitable gear means. According to a preferred embodiment, the gear ratio is as low as possible, most preferably 1:1.1. In the illustrated embodiment, the gearbox is REINTJES make, type VLJ 1030 with vertical offset of 340 mm. The reduction ratio is 1:1.149.

According to a preferred embodiment, the engine and reduction gear are resiliently mounted on the foundation of the craft. This serves to reduce the sound signature of the craft.

It will be appreciated by those skilled in the art that best performance will be provided by replacing external attachments of the engines, such as the engine supports, water filters, bilge pump and so forth, with aluminum elements rather than steel, whereby the overall weight of the ship is reduced. Contrary to conventional ships, the preferred embodiment of the ship of the present invention utilizes an engine with relatively low rpm output, thereby permitting a very low reduction ratio (here, 15%) from the engine to the water jets. This provides optimum performance at minimum cost both of manufacturing and maintenance.

The craft of the present invention is also provided with a dedicated electronic control system (not shown) for controlling the operation of the propulsion system of the ship. It will be appreciated that this control system is tailored to the particular propulsion system utilized.

The interior design of the craft also serves to provide comfort with functionality for the crew and passengers. This unique arrangement is permitted by the unusual placement of the open bridge, as compared to conventional ships.

Figure 7:
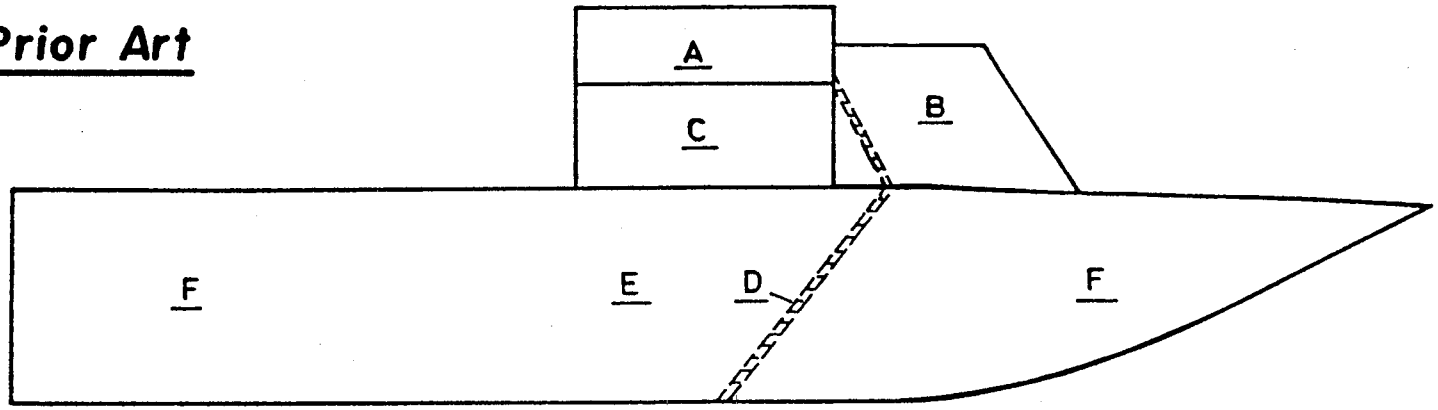
Fig. 7. Prior Art
FIG. 7 is a schematic side section of a patrol craft according to the prior art.

As discussed above, referring to FIG. 7, in conventional craft, the open bridge A is located only one half flight up from the closed bridge B and aft thereof. Since the area C under the open bridge is only half a flight high, it cannot be used as a room, but only for storage. Accordingly, the galley E must be placed below deck, requiring the sleeping quarters F to be moved forward and aft. Therefore, ammunition is stored wherever space is available. As noted above, the stairway D from below comes up directly into the closed bridge, requiring the movement of crew through the control area at all times. This is particularly disturbing during times of action when concentration is required.

Figure 8:
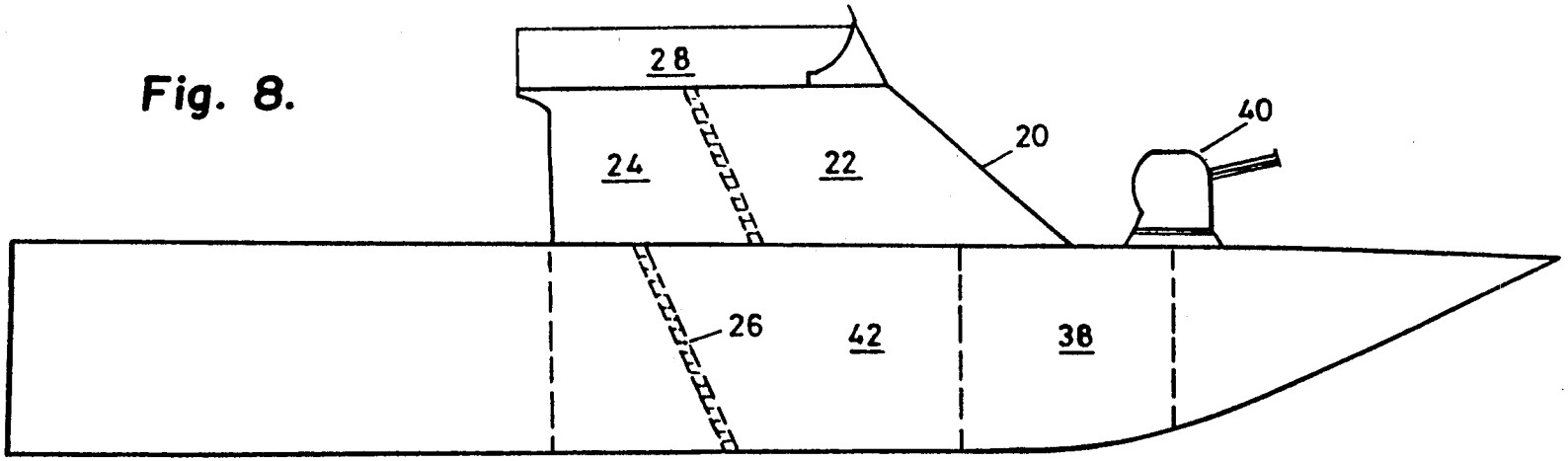
FIG. 8 is a schematic side section of a patrol craft according to the present invention.

In the design of the present invention, on the other hand, as seen in FIGS. 4,5 and 8, the main deck includes a wheelhouse 20 of aerodymanic design including control area 22 (closed bridge) for pilot and helm. An open bridge 28 is provided which includes secondary means 30 for controlling the ship, searchlight 32 and radar 34. (In the minibus version of the ship, no open bridge is required).

It is a particular feature of the present invention that the open bridge 28 is directly above the closed bridge. Thus, the closed bridge control area 22 need not be limited in size and can be designed for comfort as well as maximum efficiency. A galley and chart room 24 is provided aft of the control area, in the area usually wasted under the open bridge. Stairways 26 from below lead into the galley such that crew members can come on deck without interfering with operations in the control area 22.

Below deck in the illustrated embodiment, sleeping quarters 42 have been provided for 8 crew members. Since the galley is now on the main deck, the below deck area can be utilized for sleeping quarters for a larger number of people than can be accomodated in conventional patrol boats.

Furthermore, the fuel 36 and ammunition 38 can be stored low down in the ship (see FIGS. 2 and 5). Accordingly, a forward facing gun 40 can be mounted on the main deck with an associated ammunition compartment directly below. In conventional ships, fuel and ammunition are usually stored higher up in the ship, taking up otherwise useful space.

It will be appreciated that the patrol craft illustrated in FIGS. 2 to 6 is only one embodiment of the ship of the present invention. Similarly, a minibus or fast yacht can be built utilizing the same principles. In such a case, the interior design would be somewhat different, to reflect the different utility.

It will be appreciated by those skilled in the art that the invention is not limited to what has been shown and described hereinabove by way of example. Rather, the scope of the invention is limited solely by the claims which follow.

We claim:

1. A water craft of the 50 ton class comprising the combination of:

a fully planing outer hull having a keel, a pair of chines and a deep V-shaped forward hull portion extending for approximately the forward third of the craft and a monohedron rear hull portion extending rearwardly of said deep V forward hull portion, said rear hull portion being defined by a V-shaped bottom with bottom surfaces defined thereby being substantially convex from said keel to said chines and being angled at a substantially constant angle relative to each other;

said outer hull further including side walls extending upwardly from the perimeter of the bottom surfaces;

the hull having a hard chine and two bottom risers of triangular cross-section;

a water jet propulsion system mounted in the rear hull portion and comprising a high speed, high rpm water jet system, the maximum water jet speed being between 1400 and 1600 rpm, an engine disposed in said hull and comprising a four stroke, direct injection, water-cooled, turbo-charged, charge air cooled marine diesel engine having 16 cylinders in V configuration, said diesel engine having a maximum power of about between about 1800 and 2100 rpm and a maximum power of about 1900 kW, said water jet system operating in conjunction with said engine.

2. A water craft according to claim 1 and wherein said water jet system is coupled to the engine by a reduction gear, and said reduction gear has a ratio of about 1:1.149.

3. A water craft according to claim 2 and wherein the engine and reduction gear are resiliently mounted on the craft.

4. A water craft according to claim 1 and comprising a plurality of frame positions sequentially designated 0 to 23 and at equal spacing from one another from frame position 0 at the transom to the tip of the bow, said frame position spacing being approximately one meter, said hard chine of triangular cross-section having a base at the hull and an outermost edge, the width of the chine from the hull to said outermost edge, along the length thereof from the transcom to frame position 7 being approximately 250 mm, said width gradually decreasing to 0 mm at the bow of the craft, said chine having a horizontal lower face and an upper face defining a slope of 45 degrees therewith from said outermost edge, said chine faces tapering forwardly toward the bow, said chine having heights above the baseline of the craft of:

approximately 0.910 meters from frame position 0, at the transom, to frame position 2;

approximately 1.117 meters at frame position 10;

approximately 1.500 meters at frame position 14;

approximately 2.325 meters at frame position 22, the bow;

the slope of said chine forward of frame position 10 being approximately 6 degrees, the maximum beam of said chine at the base thereof at the hull being approximately 5 meters at the transom, frame position 0, the maximum beam of the chine outermost edge being approximately 5.50 meters at frame position 0, the transom.

5. A water craft according to claim 4 and wherein said the engine rating is:

Continuous rating 100%: 1595 kw at 1690 rpm

Overload rating for two hours within twelve hours, 110%: 1754 kw at 1745 rpm

Maximum rating for one hour within six hours, 120%: 194 kw at 1800 rpm

6. A water craft according to claim 4 and further comprising a closed bridge and an open bridge disposed directly on top of the closed bridge.

7. A water craft according to claim 6 and wherein said closed bridge consists of an aerodynamically designed wheelhouse defining a control area for driving the craft.

8. A water craft according to claim 7 and wherein a galley and chart room is provided aft of the control area.

9. A water craft according to claim 8 and further comprising stairs from below deck leading into the galley.

10. A water craft according to claim 6 and further comprising sleeping quarters for up to eight persons on the below deck.

11. The water craft of claim 4 wherein said risers comprise an upper riser and a lower riser, and wherein the upper riser of said two risers extends from said transom to beyond frame position 20, and is parallel to the longitudinal centerline of the craft between said transom and frame position 9, the beam at the upper riser and between the transom and frame position 9 being approximately 3.66 meters, the beam of the upper riser gradually decreasing to 0 at the bow, between frame positions 20 and 21;

the heights of the upper riser at the hull above the baseline of the craft being:

approximately 0.58 meters from said transom to frame position 2;

approximately 0.735 meters at frame position 10;

approximately 1.004 meters at frame position 14;

approximately 1.597 meters at frame position 20; the slope of said upper riser forward of frame position 10 being approximately 5 degrees;

the lower riser of said two risers extending between frame position 9 and said bow, between frame positions 19 and 20, the beam of said lower riser at frame position 10 being approximately 2.72 meters and gradually decreasing to 0 at the bow, the height of said lower riser above the baseline and at the hull being approximately 0.453 meters at frame position 10 and approximately 1.007 meters at frame position 19, the slope of said lower riser being approximately 3.5 degrees;

the width of each riser from the hull to the outermost edge thereof being approximately 210 mm, said outermost edges of said upper and lower risers being defined by lower and side faces at approximately 90 degrees to each other, said outermost edges of said upper and lower risers gradually tapering forward while maintaining the 90 degree relationship.

12. A water craft of the 50 ton class comprising:

a fully planing outer hull having a keel, a pair of chines and a deep V-shaped forward hull portion extending for approximately the forward third of the craft and a monohedron rear hull portion extending rearwardly of said deep V forward hull portion, said rear hull portion being defined by a V-shaped bottom with bottom surfaces defined thereby being substantially convex from said keel to said chines and being angled at a substantially constant angle relative to each other;

said outer hull further including side walls extending upwardly from the perimeter of the bottom surfaces;

said hull having a transom and a bow, a plurality of frame positions sequentially designated to 0 to 23 and at equal spacing from one another from frame position 0 at the transom to the tip of the bow, said frame position spacing being approximately one meter, said craft having a hard chine of triangular cross-section with the chine having a base at the hull and an outermost edge, the width of the chine from the hull to said outermost edge, along the length thereof from the transom to frame position 7 being approximately 250 mm, said width gradually decreasing to 0 mm at the bow of the craft, said chine having a horizontal lower face and an upper face defining a slope of 45 degrees therewith from said outermost edge, said chine faces tapering forwardly toward the bow, said chine having heights above the baseline of the craft of:

approximately 0.910 meters from frame position 0, at the transom, to frame position 2;

approximately 1.117 meters at frame position 10;

approximately 1.500 meters at frame position 14;

approximately 2.325 meters at frame position 22, the bow;

the slope of said chine forward of frame position 10 being approximately 6 degrees, the maximum beam of said chine at the base thereof at the hull being approximately 5 meters at the transom, frame position 0, the maximum beam of the chine outermost edge being approximately 5.50 meters at frame position 0, the transom.

13. The water craft of claim 12 further comprises an upper riser and a lower riser wherein the upper riser of said two risers extends from said transom to being frame position 20 and is parallel to the longitudinal centerline of the craft between said transom and frame position 9, the beam at the upper riser and between the transom and frame position 9 being approximately 3.66 meters, the beam of the upper riser gradually decreasing to 0 at the bow, between frame positions 20 and 21;

the heights of the upper riser at the hull above the baseline of the craft being:

approximately 0.58 meters from said transom to frame position 2;

approximately 0.735 meters at frame position 10;

approximately 1.004 meters at frame position 14;

approximately 1.597 meters at frame position 20; the slope of said upper riser forward of frame position 10 being approximately 5 degrees;

the lower riser of said two risers extending between frame position 9 and said bow, between frame positions 19 and 20, the beam of said lower riser at frame position 10 being approximately 2.72 meters and gradually decreasing to 0 at the bow, the height of said lower riser above the baseline and at the hull being approximately 0.453 meters at frame position 10 and approximately 1.007 meters at frame position 19, the slope of said lower riser being approximately 3.5 degrees;

said upper and lower risers being triangular in cross section with the width of each riser from the hull to the outermost edge thereof being approximately 210 mm, said outermost edges of said upper and lower risers being defined by lower and side faces at approximately 90 degrees to each other, said outermost edges of said upper and lower risers gradually tapering forward while maintaining the 90 degree relationship.

* * * * *